340-567 SR

OR 3,955,184

United

Cinzori et T2043H

[11] 3,955,184

[45] May 4, 1976

[54] PASSIVE INFRARED ROOM INTRUSION DETECTOR

[75] Inventors: Robert J. Cinzori, Santa Barbara; Daniel R. Ledbetter, Goleta, both of Calif.

[73] Assignee: Hughes Aircraft Company, Culver City, Calif.

[22] Filed: Aug. 18, 1975

[21] Appl. No.: 605,495

[52] U.S. Cl. ..... 340/258 B; 250/221; 340/276

[51] Int. Cl.[2] ..... G08B 13/18

[58] Field of Search ..... 340/258 B, 258 D, 258 R, 340/276; 250/221

[56] References Cited

UNITED STATES PATENTS

| | | | |
|---|---|---|---|
| 3,476,948 | 11/1969 | Mengers | 340/276 |
| 3,524,180 | 8/1970 | Cruse | 340/258 B |
| 3,703,718 | 11/1972 | Berman | 340/258 D |
| 3,863,239 | 1/1975 | Campman | 340/258 R |

*Primary Examiner*—Glen R. Swann, III

*Attorney, Agent, or Firm*—William J. Bethurum; W. H. MacAllister

[57] ABSTRACT

An intrusion system detects changes in background radiation received from a plurality of orthogonally arranged fields of view (FOV) which preferably are defined by thin polyhedrons coextensive with the walls of the room. These fields of view are generated by a plurality of orthogonally arranged optical reflectors located in certain corners of the room, and any changes in background radiation within these fields of view are detected by one or more thermopile detectors which are optically aligned with the above optical reflectors. The low level - low frequency output signal voltages form the thermopile detectors are converted to an AC signal and amplified for use as an intrusion alarm signal.

3 Claims, 5 Drawing Figures

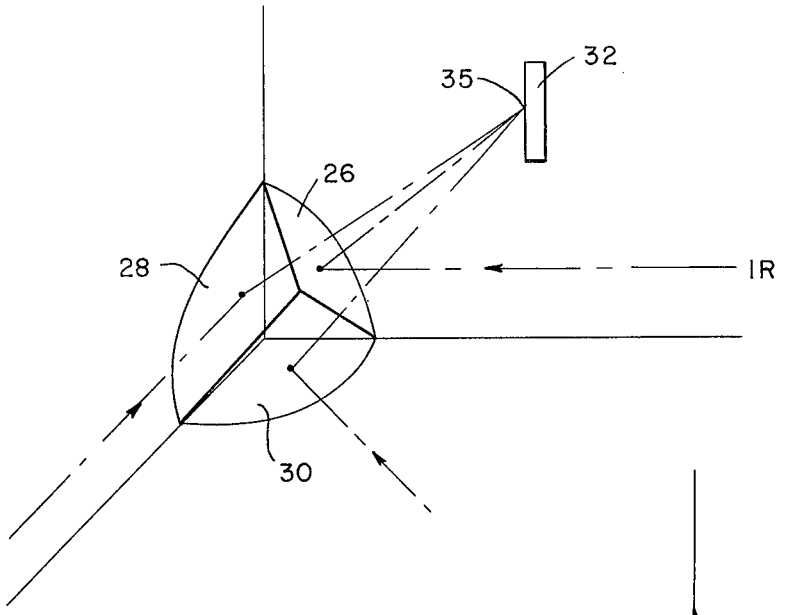
Fig. 1b.
Fig. 1c.
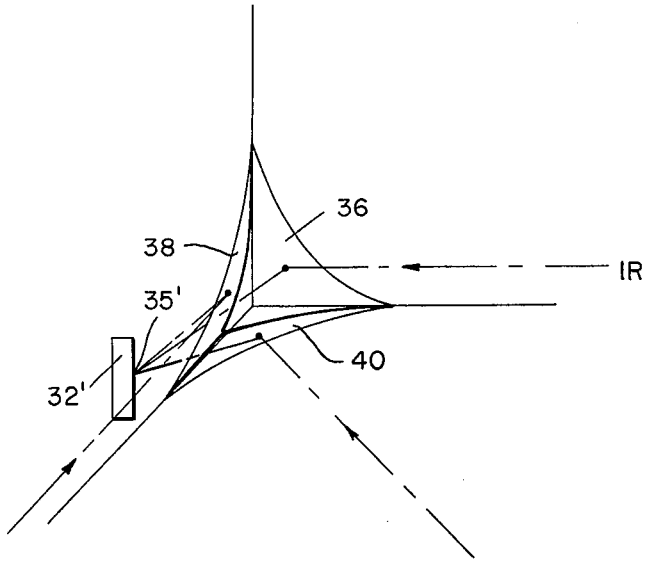
Fig. 2.
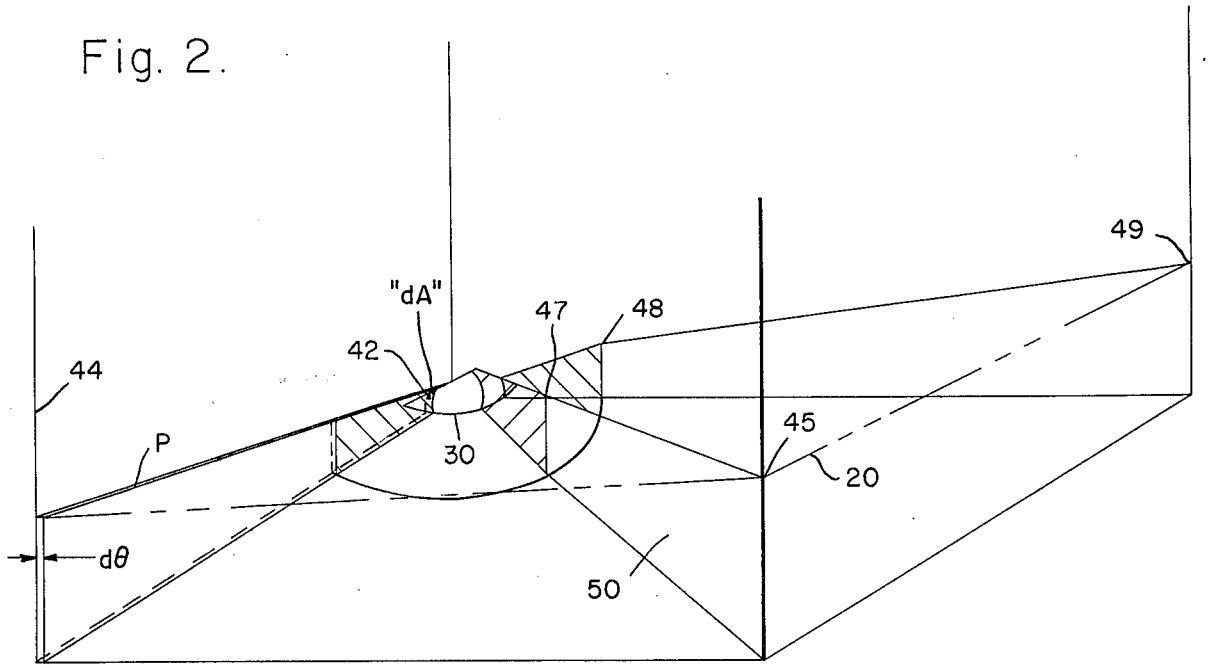

PASSIVE INFRARED ROOM INTRUSION DETECTOR

FIELD OF THE INVENTION

This invention relates generally to electro-optical intrusion alarm systems and more particularly to a universal intrusion alarm capable of forming a surveillance net enclosing an entire room.

BACKGROUND

Radiation sensitive intrusion alarm systems have received substantial interest in recent years as a result of the increase in the number of burglaries committed in the United States and various foreign countries. Such interest has been further enhanced with the advent of significant improvements made in the responsivity of infrared radiation detectors operating in the 8–15 micron wavelength range. Any object having a temperature above absolute zero emits radiation in the infrared wavelength region of the electromagnetic radiation spectrum, and the 8–15 micron wavelength range is of particular interest as a "window" in the well-known transmission spectrum for infrared radiation.

Highly sensitive thermal detectors which are responsive to 8–15 micron wavelength infrared radiation have been developed and generate a usuable electrical output signal in response to changes in levels of infrared radiation received. As a result there have been various designs proposed for electro-optical intrusion alarm systems utilizing these detectors and operative to generate numerous selected fields of view over certain areas under surveillance.

Some of the earlier electro-optical intrusion alarm systems of the above type include those which generate a field of view covering the total desired space (volume) under surveillance. When an intruder penetrates any location within this space, he creates a minute change in the total average radiation seen by the system's field of view, and this change in radiation in related to a temperature differential caused by the intruder's average temperature relative to the average background temperature of the space penetrated. This temperature differential is usually very small, i.e. less than about 1°C., and must be detected by the radiation sensor portion of the electro-optical intrusion alarm system. Since this level of sensitivity required for IR detection is constant, one solution to providing a dependable false alarm-free system with a high signal-to-noise ratio is to reduce the overall noise level in the background radiation.

PRIOR ART

In order to improve the signal-to-noise (S/N) ratio of electro-optical intrusion alarm systems which generate a field of view covering a particular volume of space to be monitored, we discovered at least as early as 1969 that it is possible to utilize a net type of surveillance to reduce background noise levels. Specifically, we discovered that a cone-shaped surveillance net (field-of-view) could be optically focused on an infrared detector in order to monitor intrusion into the volume of space defined by the cone-shaped net. Thus, anyone penetrating the relatively thin walls of the cone shaped net would produce a much greater temperature differential when referenced to the background average temperature of the net than would have been the case if the field-of-view had encompassed the entire volume of the cone.

Although our above net type surveillance intrusion alarm system will operate satisfactory for certain types of intrusion alarm applications, it is not particularly well suited for the highly sensitive total room coverage demanded by certain types of very high security intrusion alarm applications. For example, where large sums of money are stored in a typical bank vault having four walls, a ceiling and a floor, it is sometimes mandatory that an intrusion alarm system be 100 percent effective to provide an alarm indication for the slightest penetration through any portion of any wall, floor or ceiling defining the vault. When using our above described approach for generating cone-shaped surveillance nets, one encounters dead spots if the net is optically generated within the confines of the room.

THE INVENTION

In order to provide total and false alarm-free room surveillance, and in order to simultaneously provide a universal system and method for monitoring the unlawful entry into any room whose walls define a polyhedron, we have discovered a totally unique and novel solution to the above problem of dead spots in our prior art system using cone-shaped surveillance nets. Our present system and method are considered universal in the sense that this invention can be used to provide total and highly sensitive intrusion monitoring in any room whose walls, ceiling and floor define a polyhedron.

To achieve this total and flase alarm-free room surveillance, we have devised an electro-optical intrusion alarm system which includes reflector means for optically generating a plurality of orthogonal fields of view at selected corners of a room. such fields-of-view are defined as the angular measurement of predetermined volumes of space, which in a preferred embodiment of the invention are thin polyhedrons including two closely spaced and substantially coextensive planes. One of these planes includes a wall of the room under surveillance. These orthogonal fields-of-view, which are thin curtain-like polyhedrons having predetermined volumes, actually represent the finite volumes of space along side the walls of the room through which background infrared radiation passes to an orthogonally arranged optical reflector arrangement. Radiation changes within these volumes are reflected from this optical reflector arrangement to one or more thermal detectors which in turn generate a low level - low frequency electrical signal, which signal is converted to an AC signal and amplified in order to be useful as an output alarm signal.

Accordingly, it is an object of the present invention to provide a new and improved electro-optical intrusion alarm system operative to monitor the entry of an intruder through the walls, floor or ceiling of a room.

Another object is to provide an intrusion alarm system of the type described having an improved sensitivity and a high signal-to-noise ratio.

Another object is to provide an intrusion alarm system of the type described which may be constructed using the latest state-of-the-art thermopile detectors which are highly sensitive to minute radiation changes in the 8–15 micron wavelength range of the electromagnetic radiation spectrum.

A feature of the present invention is the provision of a universal method for providing total and false operationproof intrusion surveillance over any room whose walls, floor, ceiling, etc. have planar surfaces.

Another feature of this invention is the provision of a unique orthogonal optical reflector array for generating orthogonal fields-of-view which are curtain-like polyhedrons coextensive with the plane surface defining the room. This array occupies a minimum of space in a selected corner of the room.

Another feature is the provision of a method and system of the type describe which permits the free movement of people within the room under surveillence without triggering the intrusion alarm.

These and other objects and features of the invention will become more readily apparent in the following description of the accompanying drawing.

DRAWINGS

FIG. 1*a* illustrates, in perspective view, the orthogonal fields-of-view generated by the reflector array of the type described above and used in a preferred embodiment of the present invention.

FIG. 1*b* is an enlarged view of three orthogonally arranged convex reflectors which are positioned to generate three orthogonal fields-of-view from one corner of a room and each defined by a thin polyhedron coextensive with one planar surface of the room.

FIG. 1*c* is an enlarged view of three orthogonally arranged concave reflectors which are positioned to generate three orthogonal fields-of-view from one corner of a room and each defined by a thin polyhedron coextensive with one planar surface of the room.

FIG. 2 is a view of one reflecting surface (not to scale) of a reflector array in FIG. 1, and FIG. 2 also illustrates the corresponding curtain-like surveillance and field-of-view generated by such reflecting surface.

DESCRIPTION OF THE PREFERRED EMBODIMENTS

Figure 1A:
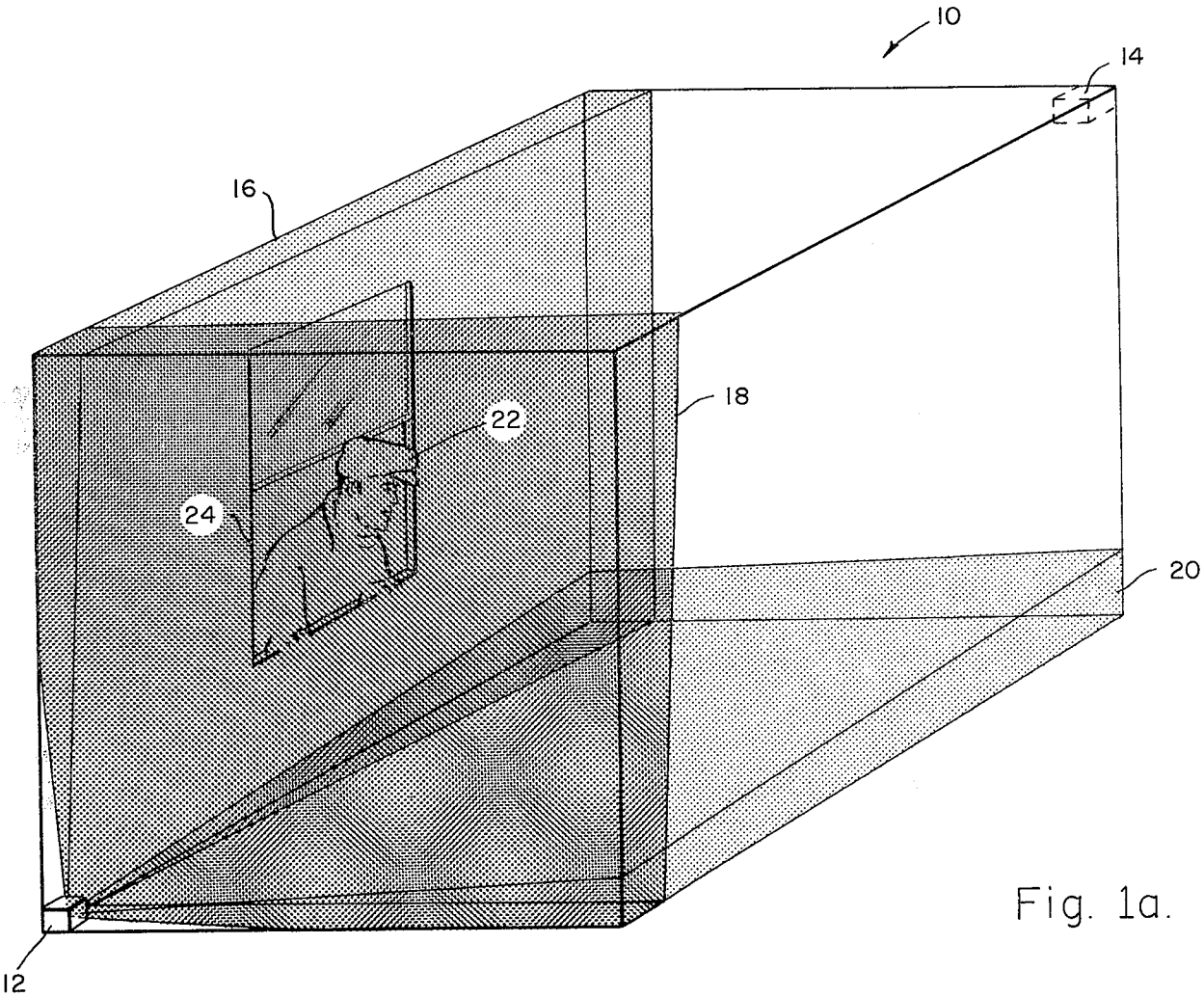

Referring now to FIG. 1, there is shown a typical four wall room 10, e.g. a bank vault, under surveillance and including a floor and a ceiling, or a total of six planar surfaces. These surfaces must be strictly monitored for intrusion through any location thereon all times. Therefore, in accordance with the present invention, one infrared detector package 12 is positioned as shown in the lower left hand corner of the room, as viewed in FIG. 1, and another identical infrared detector package 14 is positioned in the upper right hand corner of the room. Since the optics of these two detector packages 12 and 14 have three identical fields of view (FOV), only the three fields of view 16, 18 and 20 generated by the detector package 12 are illustrated by the shading in FIG. 1. Thus, the infrared detector package 12 provides complete intrusion surveillance for the near wall, the window wall and the floor of the room 10, whereas the remaining three planar surfaces of the room are covered by the three identical fields of view generated by the optics of the room detector package 14.

Each of the fields of view 16, 18 and 20 generated by the optics of the room detector package 12 is defined by a solid angle which is 90° in one direction and approximately 6° in a perpendicular direction. Thus, each of these fields of view can be defined as the angular measure of the volume of space within the above solid angle, and electromagnetic radiation from this volume of space impinges on a reflective surface which is optically aligned to the above solid angle. Such optical alignment will be described in more detail below.

Therefore, any intruder 22 or other object making the slightest penetration through an opening 24, for example, in a planar surface of the room 10 will produce an instantaneous change in the background radiation received by the detector package 12. This change in infrared radiation is then converted into an electrical signal which is processed and amplified so as to be useful as an intrusion alarm signal.

Referring now to FIGS. 1*b* and 1*c*, there are shown, respectively, two different sets of optical reflectors which are each especially suited for mounting in one corner of the room 10 in order to each optically generate three fields of view, such as FOV's 16, 18 and 20. For example, the three highly polished convex reflective surfaces 26, 28 and 30 in FIG. 1*b* will optically reflect to the IR detector surface 32 all infrared radiation received from the fields of view 16, 18 and 20, respectively. That is to say, the center of the radiation sensitive surface 32 of the thermopile detector 34 is positioned at the focal point 35 for all three reflecting surfaces 26, 28 and 30. Any change in the background radiation within any of the above three fields of view 16, 18 and 20 produces a corresponding radiation responsive output signal voltage from the thermopile detector 34, and this voltage may then be processed in a manner to be described so as to be useful as an intrusion alarm indication signal.

The concave reflectors 36, 38 and 40 in FIG. 1*c* may be used instead of the convex reflectors in FIG. 1*b*, and the concave reflectors have a focal point 35′ located as indicated in the foreground of FIG. 1*c* near the left hand wall of the room 10. These concave reflectors 36, 38 and 40 generate fields of view identical or substantially identical with those of the convex reflecting surfaces in FIG. 1*b*. In a preferred embodiment of the invention, each of these fields of view may be defined as a thin curtain-like polyhedron which is substantially coextensive with and adjacent to a planar surface of the room, and in fact bounded on one side by such surface. Obviously, the 6° angle of the field of view may be varied in order to vary the signal-to-noise (S/N) ratio of the detection system.

Referring now to FIG. 2, there is shown in an enlarged view the generation of the single field of view 20 (see FIG. 1*a*) by the reflecting surface 30 which is mounted on or closely adjacent to the surface of the floor of the room 10. The reflecting surface 30 is configured and positioned so that a "dA" incremental area 42 of this surface "sees" the radiation emanating from the incremental volume defined by the area of the plane "P" multiplied by the incremental angle "$d\theta$". The contour of the reflecting surface 30 is such that the integration of dA 90° over the area of the surface 30 corresponds to the volumeric integration of $P.d\theta$ over the 90° angle of the FOV 20 shown in FIG. 2. This integrated volume, or field of view, has a point of maximum vertical height at point 45 in the near or foreground corner of the room 10, and the contour of the reflecting surface 30 is such that one edge of dA is in vertical alignment with one corner 44 of the room 10. As "dA" is integrated from left to right and 90° over the reflecting surface 30, it passes through the vertical planes 47 and 48 which include the foreground corner 45 of the room and the background corner 49. Portions of the field of view 20 on opposite sides of the plane 47 are symmetrical with respect to this plane.

Figure 3:
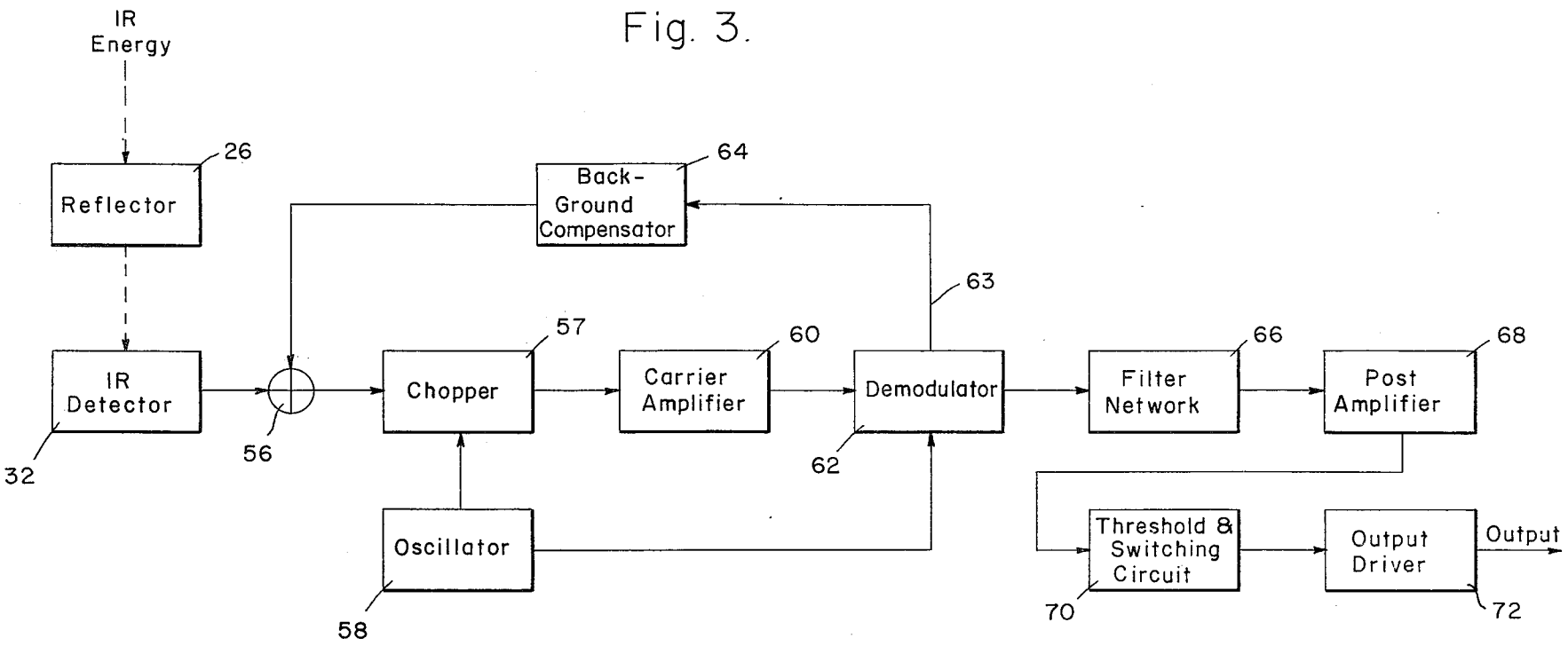
FIG. 3 illustrates generally the electronics of our system for frequency converting and amplifying a low level - low frequency IR signal received from the above described orthogonal fields-of-view.

Referring now to FIG. 3, there is shown an electro-optical system for sensing and processing any changes in infrared radiation received by an infrared detecting surface 32 from any of the above described six fields of view surrounding the room 10. Such changes in radiation may be produced by the intrusion of an object through any field of view (e.g. 18) planar to any surface of the room 10. The corresponding change in radiant power, ΔP, produced by such object and received at a reflecting surface 26, is equal to a constant, K, times the area of the intruded target seen by the field of view, $A_t$, times the third power of the average background temperature, $T^3$, times the corresponding intrusion-produced change in temperature ΔT within a given field of view, divided by the 2nd power of distance between the reflecting surface 26 and the intruder, $R^2$. That is:

$$\Delta P = \frac{K \cdot A_t \cdot T^3 \cdot \Delta T}{R^2} \quad (1)$$

Additionally, the change in output voltage, ΔV, of the thermopile detector 34 is equal to the responsivity, R, of the detector times ΔP, or:

$$\Delta V = R.\Delta P \quad (2)$$

This change in voltage, $\Delta V$, is coupled to a summing amplifier network 56 whose output is in turn connected to drive a high frequency chopper 57. The low level nanovolt signal at the input of the chopper 57 is converted by the chopper to a high frequency chopped signal which is frequency dependent upon the frequency of the driving oscillator 58. The full wave chopper 57 alternately switches the polarity of the signal from detector 34 from positive to negative with respect to ground, and the signal from the chopper 57 is an amplitude modulated square wave which is fed into a carrier amplifier 60.

The carrier amplifier 60 is an AC bandpass amplifier which is designed specifically for boosting the amplitude of the modulated square wave from the chopper 57, and the bandwidth of the amplifier 60 is selected so that very little harmonic content of the square wave from the chopper 57 is lost due to high frequency attenuation. This characteristic of the amplifier 60 in effect preserves the information signal on the chopped square wave from stage 57, and the amplified output signal from the amplifier stage 60 is substantially identical in form, but greater in amplitude, to the signal at the input of the amplifier stage 60.

The output signal of the amplifier stage 60 is fed to a demodulator stage 62 which, in a preferred embodiment of the invention, is a synchronous detector. The synchronous detector 62 is generally well known in the art and functions as an oscillator (58) driven switch necessary to maintain an in phase signal relationship between the signal at the output of the chopper 57 and the demodulated output signal from detector 62. If a Fourier analysis were performed on the output waveform from the demodulator stage 62, one would find that the DC component and the signal component terms of the output signal from the IR detector 34 are completely restored at the stage 62 output.

The output signal from the synchronous detector 62 is fed back through one path 63 to a background compensating network 64, and this network 64 is required when large offset signals are generated by backgrounds, such as a heater, warm walls, etc. These large offset signals will otherwise tend to drive the carrier amplifier 60 into saturation, thereby suppressing the modulation signal applied thereto. The background compensator stage 64 filters out all but the DC component term from the output of the demodulator stage 62, and this DC term either adds to or subtracts from the detector signal (from 32) in the summing network 56, at a very slow rate. This function reduces the total DC component term of the signal from detector 32 (sometimes called offset) towards zero, thereby extending the overall AC dynamic range of the preamplifier stage 60.

The filter network 66 allows the information signal frequencies at the output of stage 62 to pass to the post-amplifier stage 68 with a minimum of attenuation, and also blocks passage of all other unwanted frequencies. These unwanted frequencies are the low frequency and DC component terms generated by background-plus-offset voltage caused by leakage currents within the amplifier stage 60. Additionally, these unwanted terms include high frequencies generated by the high frequency square wave output from the chopper stage 57, including all its harmonic content, and all of the corresponding sideband frequencies from this square wave.

The signal at the output of the filter network 66 is substantially identical in form, but greater in amplitude, to that seen at the output of the thermopile detector 32; but there is no DC component in this amplified signal. After the signal has passed through both the filter network 66 and the post amplifier stage 68, it is fed to the threshold and switching circuit 70. Preferably, the threshold and switching circuit 70 is a modified Schmitt trigger circuit which converts low frequency amplified signals to digital pulses which are suitable for driving digital output circuitry 72. The output driver circuitry 72 is designed, of course, to meet specific requirements and may, for example, include components such as a relay switch, an RF transmitter, a light, or an audio alarm.

Various modifications may be made in the particular reflector design and contour without departing from the scope of this invention.

What is claimed is:

1. A system for monitoring entry through any one of a plurality of planar surfaces of a room, which system includes a. one or more means for optically reflecting or refracting to a predetermined location any changes in radiation received from a plurality of polyhedrons, each having a plane adjacent a separate one of said surfaces, b. a detection means at said location optically coupled to said reflecting or refracting means for generating a low level - low frequency signal voltage in response to radiation changes received from said polyhedrons, and c. signal processing means coupled to said detection means for converting and amplifying said low level - low frequency signal voltage so as to be useful as an alarm signal indicating surreptitious entry through one of said surfaces.

2. The system defined in claim 1 wherein each said reflecting or refracting means is comprised of a plurality of mutually adjacent optical surfaces which are contoured and positioned to have a common focal point with respect to all radiation received from selected ones of said polyhedrons, whereby said optical surfaces may be positioned in a corner of a room and optically coupled to a single infrared detector at said common focal point and operative to detect all radiation changes from said polyhedrons defining mutually perpendicular fields-of-view adjacent said planar surfaces of said room.

3. A method for sensing intrusion into a space whose volume is defined as a polyhedron, which includes:

a. optically reflecting to a predetermined location or locations background infrared radiation received from a plurality of fields-of-view defined by solid angles adjacent, respectively, a plurality of planar surfaces of said polyhedron, and b. electrically sensing changes in said background radiation to thereby generate a corresponding low level - low frequency signal voltage which may be converted and amplified for use as an output alarm signal.

* * * * *